US009610554B2

(12) United States Patent
Yamamoto et al.

(10) Patent No.: US 9,610,554 B2
(45) Date of Patent: Apr. 4, 2017

(54) STIRRING APPARATUS

(71) Applicants: MITUYATEC INC., Sakai-shi, Osaka (JP); KAWAMOTO CHEMICAL INDUSTRIES INC., Osaka-shi, Osaka (JP)

(72) Inventors: Yoshikazu Yamamoto, Sakai (JP); Hiroki Sugawara, Sakai (JP)

(73) Assignees: MITUYATEC INC., Sakai-Shi, Osaka (JP); KAWAMOTO CHEMICAL INDUSTRIES INC., Osaka-Shi, Osaka (JP)

( * ) Notice: Subject to any disclaimer, the term of this patent is extended or adjusted under 35 U.S.C. 154(b) by 0 days.

(21) Appl. No.: 14/411,435

(22) PCT Filed: Nov. 25, 2013

(86) PCT No.: PCT/JP2013/006906

§ 371 (c)(1),
(2) Date: Dec. 26, 2014

(87) PCT Pub. No.: WO2014/184831

PCT Pub. Date: Nov. 20, 2014

(65) Prior Publication Data

US 2016/0051950 A1 Feb. 25, 2016

(30) Foreign Application Priority Data

May 16, 2013 (JP) ..... 2013-104309

(51) Int. Cl.
*B01F 7/00* (2006.01)
*B01F 15/00* (2006.01)
*B01F 11/00* (2006.01)

(52) U.S. Cl.
CPC .... *B01F 15/00538* (2013.01); *B01F 7/00683* (2013.01); *B01F 7/00725* (2013.01);
(Continued)

(58) Field of Classification Search
CPC ..... B01F 7/00725
(Continued)

(56) References Cited

U.S. PATENT DOCUMENTS 2,302,804 A * 11/1942 Schatz ..... B01F 11/0097 366/209
4,669,225 A 6/1987 Kuster
4,784,338 A * 11/1988 Saladin ..... F16H 21/46 241/101.2

FOREIGN PATENT DOCUMENTS

JP 1986-74962 A 4/1986
JP 11276874 A 10/1999
(Continued)

*Primary Examiner* — David Sorkin
(74) *Attorney, Agent, or Firm* — Muncy, Geissler, Olds & Lowe, P.C.

(57) ABSTRACT

Provided is a stirring apparatus that can drive a stirring body with a simple structure and without applying excessive force. The stirring apparatus is provided with: the stirring body, which is a two-circle roller having an axis of rotation and two stirring fins; first and second drive shafts with axial centers not matching the axis rotation; a first shaft coupling, which connects the first drive shaft on a first stirring fin side of the axis rotation; a second shaft coupling, which connects the second drive shaft on a second stirring fin side of the axis of rotation; and a driving unit that exclusively carries out rotary drive of only either of the first and second drive shafts. The driving unit is provided with a regulating member that makes a teeth angular range of a first gear face a power-driven gear without play at a rotary position where the boundary between the teeth angular range and a missing teeth angular range of the first gear faces the power-driven gear and makes a teeth angular range of a second gear face the power-driven gear without backlash at a rotary position
(Continued)

where the boundary between the teeth angular range and a missing teeth angular range of the second gear faces the power-driven gear.

8 Claims, 21 Drawing Sheets

(52) U.S. Cl.
CPC ..... *B01F 11/0097* (2013.01); *B01F 15/0048* (2013.01); *B01F 15/00441* (2013.01); *B01F 2015/00649* (2013.01)

(58) Field of Classification Search
USPC ..... 366/287, 288, 331
See application file for complete search history.

(56) References Cited

FOREIGN PATENT DOCUMENTS

| | | | |
|---|---|---|---|
| JP | 2002-143665 | A | 5/2002 |
| WO | 87/03351 | A1 | 6/1987 |

* cited by examiner

STIRRING APPARATUS

CROSS REFERENCE TO RELATED APPLICATIONS

This application is a national stage of International Application No. PCT/JP2013/006906 filed on Nov. 25, 2013, and also is based on Japanese Patent Applications Nos. 2013-104309 filed on May 16, 2013 and 2012-21933 filed on Feb. 3, 2012, the disclosures of which are incorporated herein by reference.

BACKGROUND OF THE INVENTION

Field of the Invention

The present invention relates to a stirring apparatus for stirring liquid.

Description of the Related Art

Patent Literature 1 and 2 disclose apparatuses which make a stirring body rotate with swing to stir liquid. The stirring apparatus mentioned above makes the stirring body rotate with swing complicatedly to stir the liquid so that it is able to stir the liquid efficiently only with small power.

PRIOR ART REFERENCE

Patent Literature

Patent Literature 1: JP 1986-74962 A
Patent Literature 2: JP 2002-143665 A

BRIEF SUMMARY OF THE INVENTION

Technical Problem

The stirring apparatus mentioned above is what makes a stirring body rotate with swing by supporting the right and left sides of the stirring body with each universal joint and transmitting rotation of right and left drive shafts through the right and left universal joints. Generally the universal joint generates a periodic angle deviation when rotation is transmitted from the drive shaft to a driven shaft. Therefore, if the right and left drive shafts are made to rotate in the same rotation number (angle speed), the apparatus does not only rotate normally but also gets broken because unreasonable force is added to a mechanism by the deviation of the rotation angle mentioned above.

Thus, for the apparatus in the patent literature 1, the deviation of the rotation angle is solved in fluidity of the liquid by driving with a hydraulic motor. For the apparatus in the patent literature 2, the deviation of the rotation angle is solved by making the drive shaft itself a motor and making it noncontact which is electromagnetically coupled to a stator. However, these mechanisms have problems that the efficiency is decreased because it is not a mechanical direct transmission of the power as well as that these are complicated.

The present invention is aimed at providing a stirring apparatus which has a simple structure and can drive a stirring body without adding unreasonable force.

Solution to Problem

The stirring apparatus of the present invention comprises a stirring body, first and second drive shafts, first and second universal joints and a driving unit. The stirring body has a rotation shaft and first and second stirring fins provided along the shaft direction of the rotation shaft. The rotation shafts and the shaft centers of the first and second drive shafts aren't in-line. The first shaft coupling connects the first drive shaft to the side of the first stirring fin of the rotation shaft, and the second shaft coupling connects the second drive shaft to the side of the second stirring fin of the rotation shaft. The driving unit drives the first and second drive shaft to rotate.

The driving unit comprises a first missing teeth gear for intermittently transmitting driving force to the first drive shaft, a second missing teeth gear for intermittently transmitting driving force to the second drive shaft and a power-driven gear for transmitting driving force to the first and second missing teeth gear. The driving unit further comprises a regulating member for making the first gear oppose the power-driven gear with little backlash at the rotational position where the boundary between a teeth angular range of the first gear and a missing teeth angular range is opposed to the power-driven gear and making the second gear oppose the power-driven gear with little backlash at a rotational position where the boundary between a teeth angular range of the first gear and a missing teeth angular range is oppose to the power-driven gear.

Opposing and releasing may be performed smoothly as the regulating member makes backlash of the first gear and the power-driven gear increase as the rotational position of the first gear departing from the position where the boundary between the teeth angular range and a missing teeth angular range is opposed to the power-driven gear, and the regulating member makes backlash of the second gear and the power-driven gear increase as the rotational position of the second gear departs from the position where the boundary between the teeth angular range and the missing teeth angular range is opposed to the power-driven gear.

Further, the present invention may be constituted as follows. It is constituted that the first stirring fin has a first stirring face and the second stirring fin has a second stirring face whose direction is different from the first stirring face. The driving unit drives the first drive shaft to rotate with the first missing teeth gear meshing with the power-driven gear and the second missing teeth gear being opposed to the power-driven gear when the first stirring fin swings to the direction of the first stirring face. The driving unit drives the second drive shaft to rotate with the second missing teeth gear meshing with the power-driven gear and the second missing teeth gear opposed to the power-driven gear when the second stirring fin swings to the direction of the second stirring face. Driving only either of the first or second drive shafts to rotate exclusively is carried out.

It may also be applied an envelope shape of a two circle roller having a center at a prescribed interval on the rotation shaft and comprising of two disks which have same diameters orthogonal each other as the stirring body of the present invention.

Furthermore, the prescribed interval may be the interval of $\sqrt{2}$ times the radius of the disk.

Advantageous Effects of Invention

According to the present invention, it will be possible to drive the stirring body with a simple structure without adding unreasonable force.

DETAILED DESCRIPTION OF THE EMBODIMENT

Figure 1:
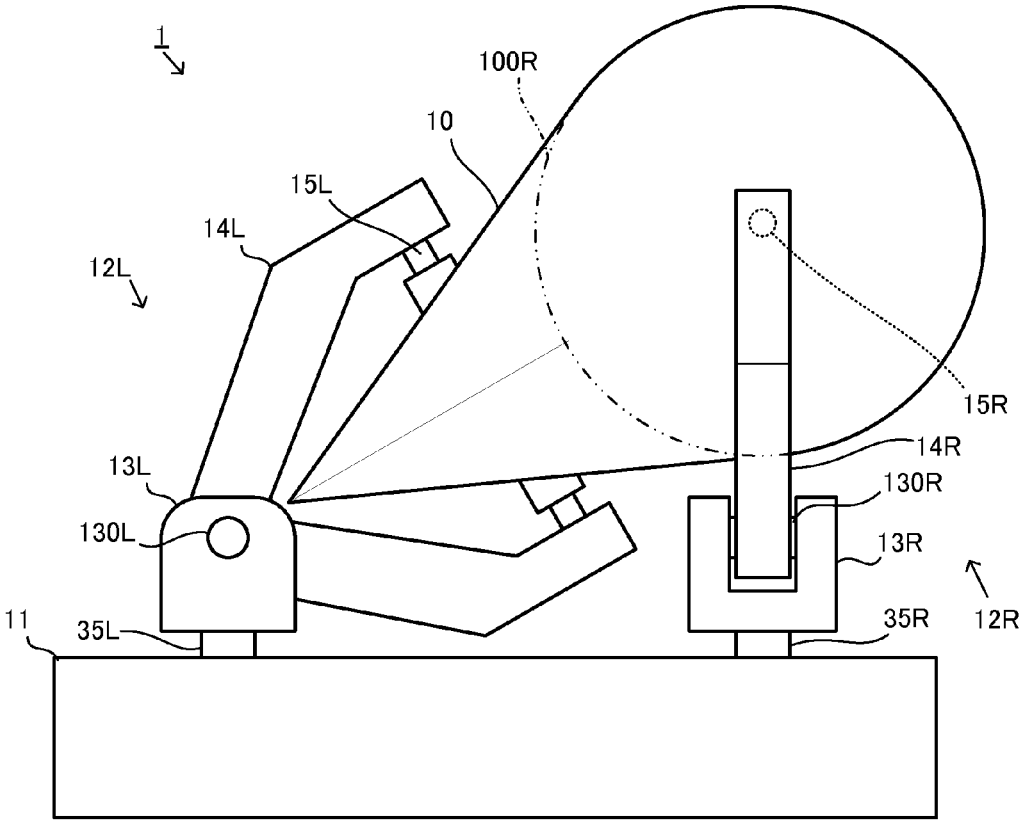
FIG. 1 is an elevation view of a stirring apparatus which is the embodiment of the present invention.

Hereinafter, referring to the figures, a stirring apparatus as the embodiment of the present invention is explained. FIG. 1 is an elevation view of the stirring apparatus which is the embodiment of the present invention. A stirring apparatus 1 is set in liquid, which has a stirring body 10, a supporting base 11, a universal joint 12R, 12L and a drive mechanism 30 built in the supporting base 11.

In this description, directions of up, down, right and left of the stirring apparatus 1 shown in FIG. 1 are called the up, down, right and left respectively, and also the back is the back side of the paper and the front is the front side of the paper of FIG. 1.

The stirring body 10 is a smooth solid supported by the universal joint 12R, 12L on the supporting base 11. The stirring body 10 is an envelope shape of a two circle roller (a solid enclosed by a line that connects the grounding points) shown in FIG. 2. The liquid is stirred by making the stirring body 10 rotate with swing driven by the drive mechanism 30 and the universal joint 12R, 12L.

Figure 2:
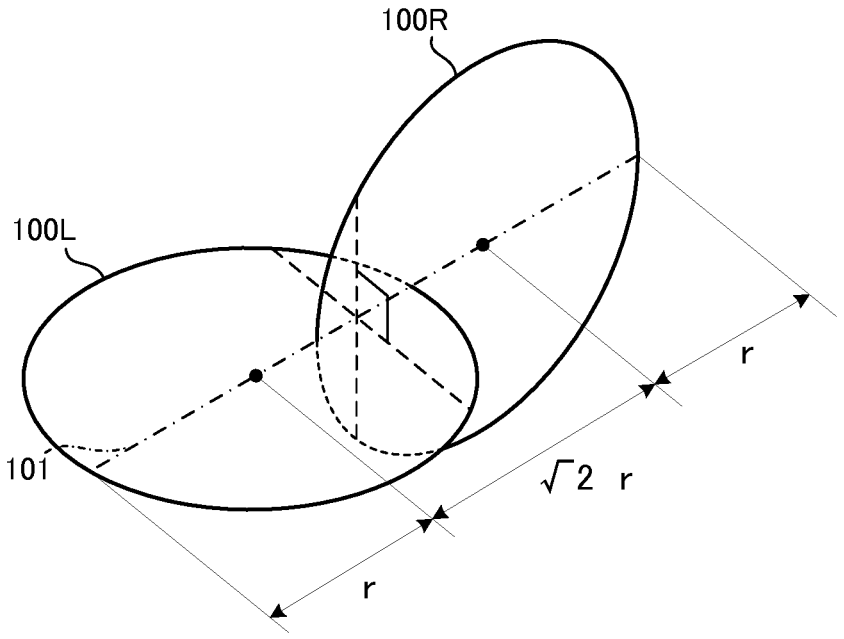
FIG. 2 is a diagram showing a two circle roller which is a basic structure of the stirring apparatus.

FIG. 2 shows an example of the two circle roller. The two circle roller shown in FIG. 2 is provided by two disks, a disk 100R, 100L, of radius r arranged in a distance between the centers of $\sqrt{2}r$ with the central axes thereof twisting each other to 90-degree. A straight line passing through the center of the two disks, the disk 100R, 100L is a rotation shaft 101 of the stirring body (two circle roller) 10. The stirring body 10 shown in FIG. 1 is the envelope shape of the two circle roller, which contains a virtual disk 100R, a virtual disk 100L and a virtual rotation shaft 101.

The rotation angle of the stirring body (rotation shaft 101) used in the following description is in the attitude of FIG. 1, that is, the angle of the attitude that the right virtual disk 100R is vertical is 0-degree with the left fork 14L facing the front, the right fork 14R facing the side. The normal rotation direction of the stirring body 10 is a direction when the drive shaft 35R, 35L rotates clockwise and counterclockwise respectively (clockwise seen from the left).

The stirring body 10 is connected to the universal joint 12R, 12L at a support shaft 15R and a support shaft 15L which pass through central axes of the virtual disk 100R, 100 L respectively. The support shaft 15R, 15L is free to rotate around the central axes of the virtual disk 100R, 100L. The universal joint 12R, 12L have the supporting shaft 15R, the supporting shaft 15L, the fork 14R, the fork 14L, a hinge 13R, 13L. The hinge 13R, 13L are fixed to the top of the drive shaft 35R, 35L sticking on the support base 11 of the drive mechanism 30 (see FIG. 9) and supports the fork 14R, 14L swinging freely in the plane vertical to a swing shaft 130R, 130L. The fork 14R, 14L are supported by the hinge 13R, 13L swinging freely and rotatably supports freely at both ends of the support shaft 15R, 15L.

The drive shaft 35R, 35L are respectively rotated in opposite directions by the drive mechanism 30 explained later. For example, the drive shaft 35R rotates to the right (clockwise, seen from above) and the drive shaft 35L rotates to the left (counterclockwise, seen from above). As being fixed to the drive shaft 35R, 35L, the hinge 13R, 13L are rotated with the drive shaft 35R, 35L. The fork 14R, 14L also rotate to the horizontal direction in accordance with the rotation of drive shaft 35R, 35L and swing in the plane vertical to the swing shaft 130R, 130L around the swing shaft 130R, 130L of the hinge 13R, 13L, supporting the stirring body 10 with the support shaft 15R, 15L. The stirring body 10 is made to rotate with swing and stirs liquid in accordance with the rotation and swinging of the fork 14R, 14L.

Figure 3:
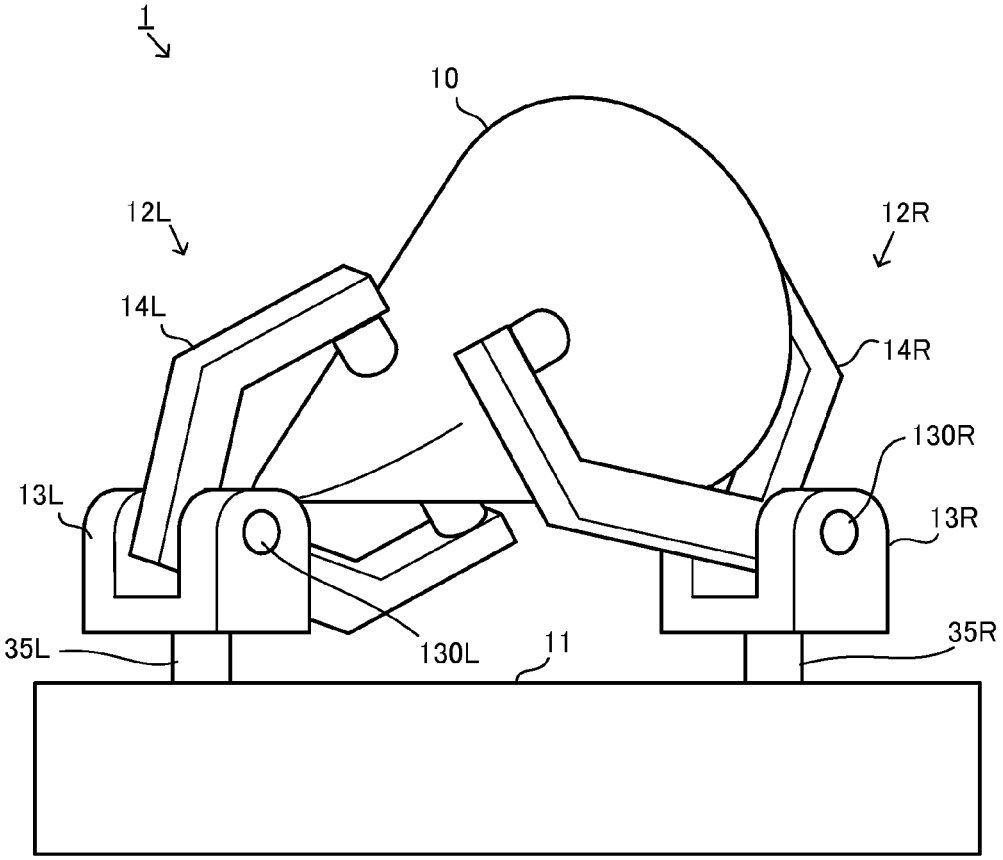
FIG. 3 is an elevation view of the stirring apparatus whose attitude is changed.

FIG. 3 is a diagram showing the attitude of the stirring body 10 and the fork 14R, 14L of the stirring apparatus 1 when the stirring body 10 is rotated to 45-degree, that is, when the stirring body 10 of the stirring apparatus is rotated to 45-degree from the attitude in FIG. 1 (the rotation angle 0-degree). In the diagram, the right side of the fork 14R is rotated clockwise and makes the right side of the stirring body 10 (the virtual disk 100R) swing as tipping forward while the left side of the fork 14L is rotated counterclockwise and makes the left side of the stirring body 10 (the virtual disk 100L) lift above the attitude in FIG. 1, compared with the FIG. 1 wherein the rotation angle is 0-degree. Thus, the stirring body not only rotates about the rotation shaft 101, but swings up and down, front and back, right and left by the swing of the fork 14R, 14L.

Referred from FIG. 4A to FIG. 8D, the swing rotation of the stirring body 10, that is, stirring motion will be explained. In the following explanation, the stirring body 10 will be explained shown as a shape of a two circle roller for clarity of explaining and understanding. Motion of the left side of the stirring body 10, that is, a disk 100L is also primarily explained. The stirring body 10 is plane-symmetrical to the plane containing the disk 100R and is plane-symmetrical to the plane containing the disk 100L. The front side and the back side of the disk 100R, 100L act the same way. Therefore, the stirring body 10 performs one stirring cycle by 180-degree of its motion and two stirring cycles are performed during one revolution (360-degree rotation) of the stirring body 10.

Figure 4A:
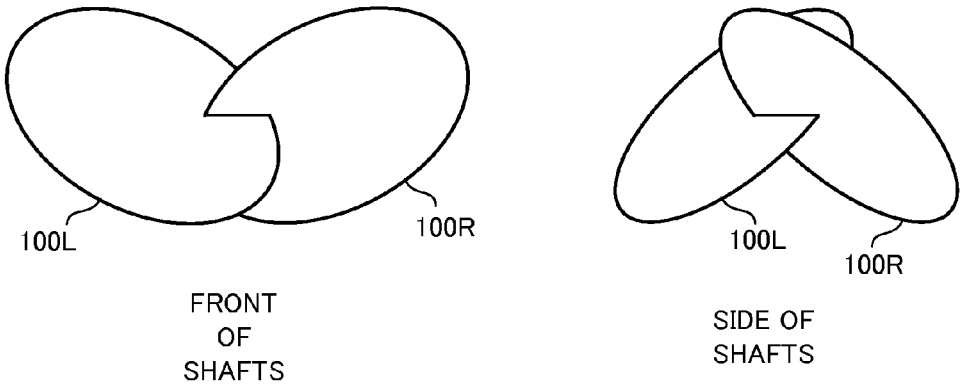
FIG. 4A is a diagram illustrating an attitude change of the stirring body.
Figure 4B:
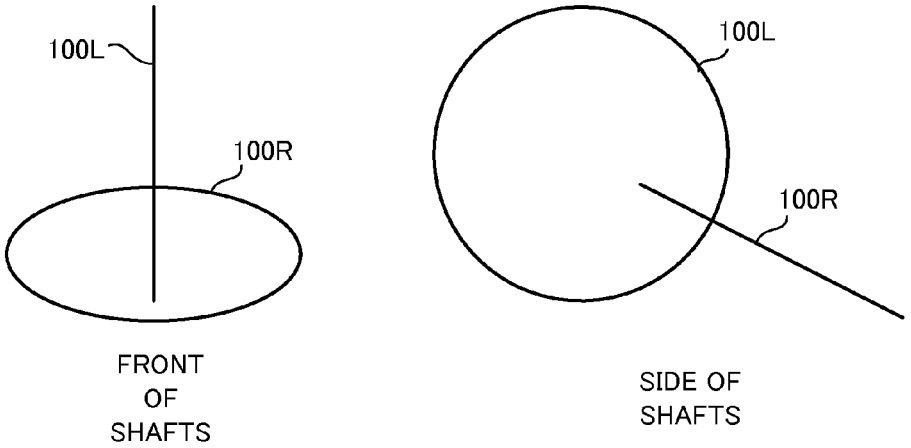
FIG. 4B is a diagram illustrating an attitude change of the stirring body.
Figure 4C:
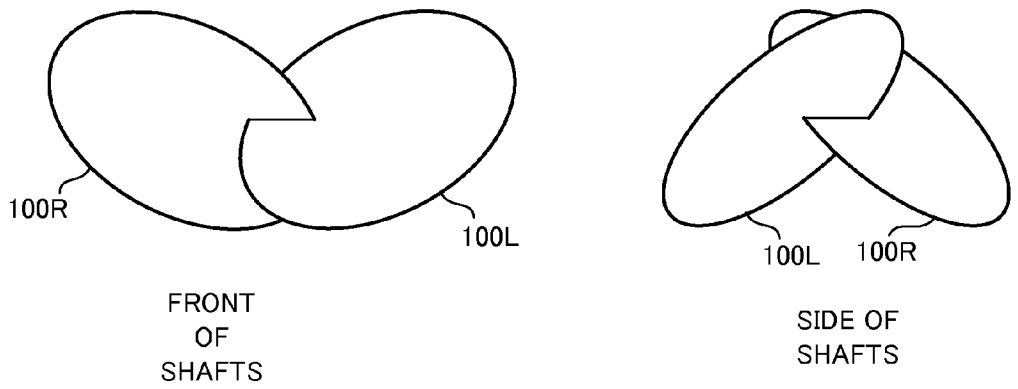
FIG. 4C is a diagram illustrating an attitude change of the stirring body.
Figure 4D:
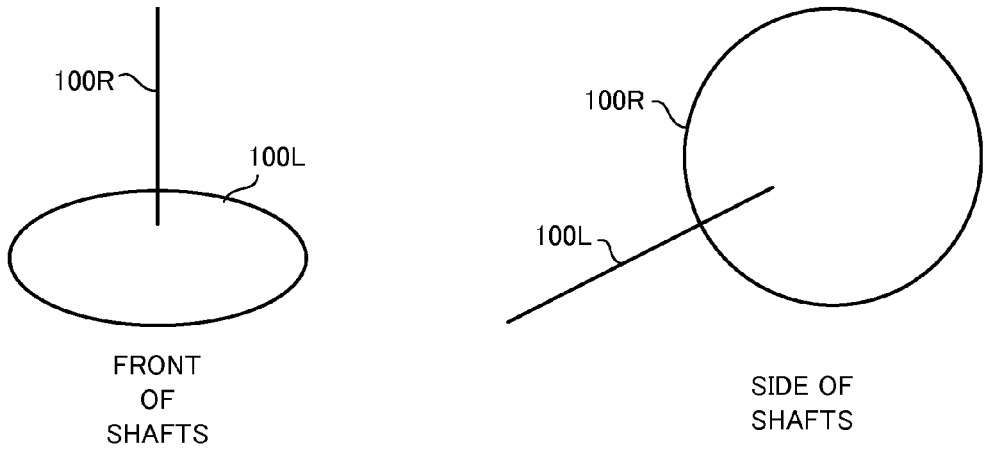
FIG. 4D is a diagram illustrating an attitude change of the stirring body.

The diagrams in the right side of FIG. 4A to FIG. 4D are those of the stirring body 10 seen from the front of the stirring apparatus 1 same as the diagrams shown in FIG. 1 and FIG. 3. The diagrams in the left side of FIG. 4A to FIG. 4D are those of the stirring body 10 seen from the left side of the stirring apparatus 1. FIG. 4A shows an attitude of the stirring body 10 (the two circle roller) whose rotation angle is 45-degree. FIG. 4B shows an attitude of the stirring body 10 whose rotation angle is 90-degree. FIG. 4C shows an attitude of the stirring body 10 whose rotation angle is 135-degree. FIG. 4D shows an attitude of the stirring body 10 whose rotation angle is 180-degree (0-degree). The stirring body 10 changes its attitude in order of FIG. 4A, FIG. 4B, FIG. 4C, FIG. 4D and then back to FIG. 4A by the drive shaft 35R rotating clockwise and the drive shaft 35L rotating counterclockwise. Further, FIG. 8A to FIG. 8D are diagrams showing the stirring body 10 which is shown as the shape of the two circle roller in FIG. 4 to FIG. 4 as an envelope shape as illustrated in FIG. 1.

Figure 5A:
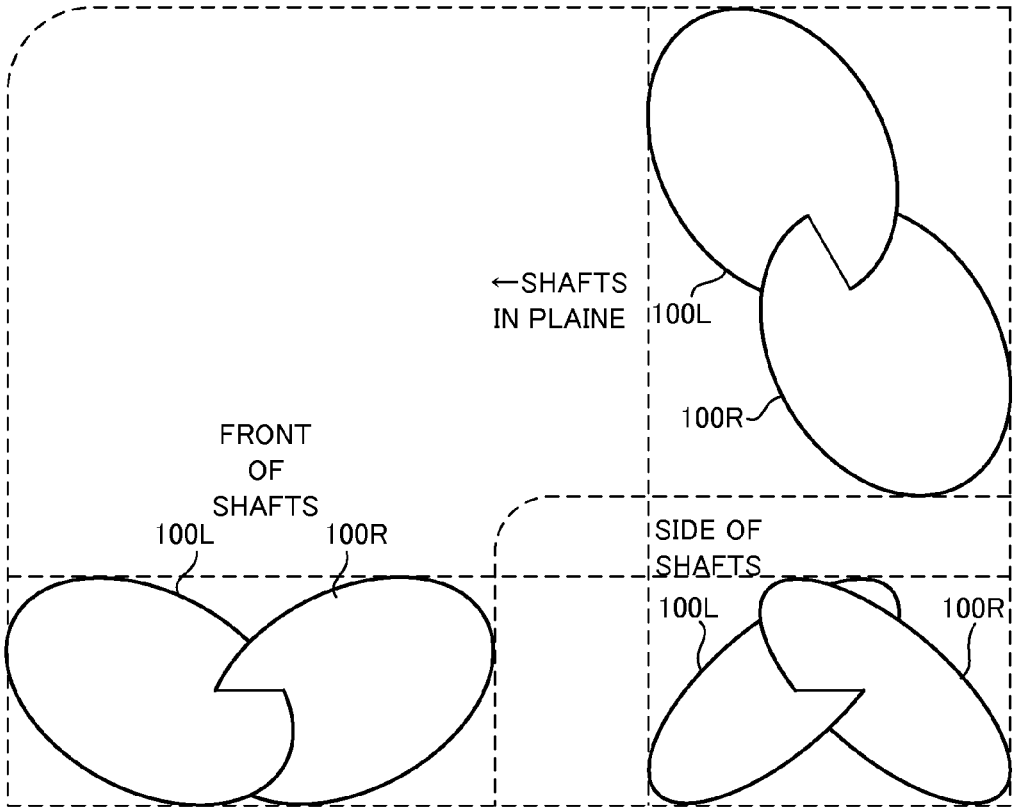
FIG. 5A is a diagram illustrating an attitude change of the stirring body.

In FIG. 4A, when the rotation angle is 45-degree, the stirring body 10 is in a twisted attitude wherein the left side is moved to back and the right side is moved to front by the fork 14R, 14L swinging in the front-back direction. For clarity of the attitude, FIG. 5A shows a trihedral figure of the stirring apparatus 10 whose rotation angle is 45-degree. As can be seen in this plan view, the left disk 100L whose surface is towards the upward direction in front is located slightly in back. On the contrary, the right disk 100R whose periphery is towards the downward direction in back is located slightly in front.

Figure 5B:
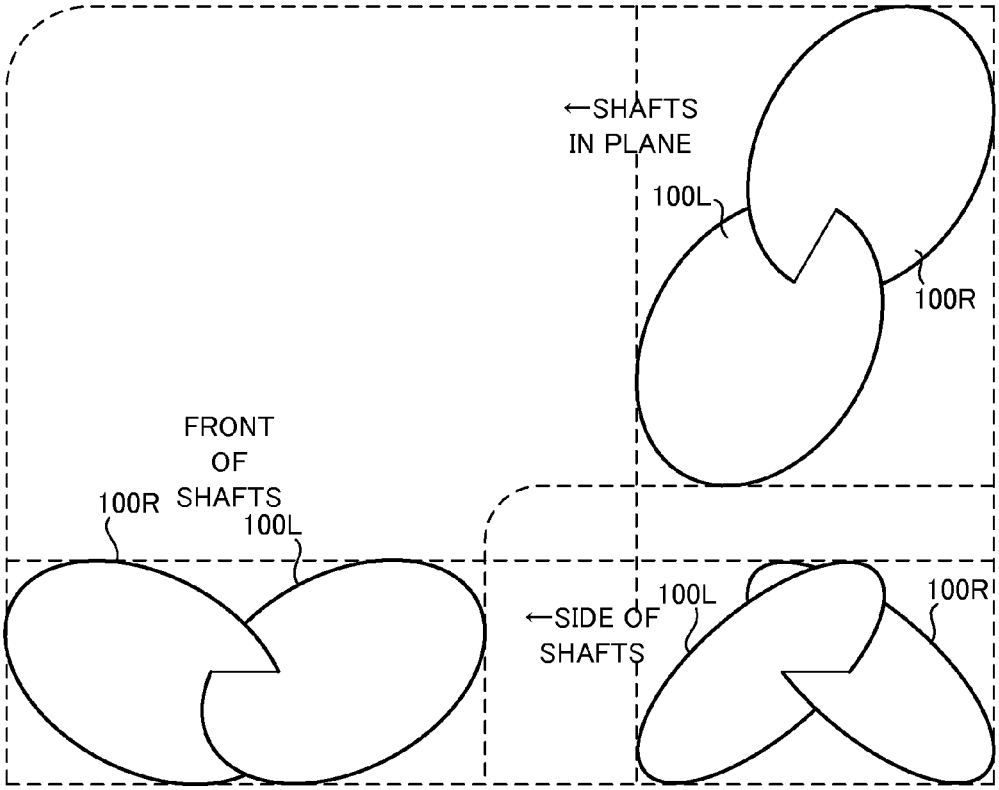
FIG. 5B is a diagram illustrating an attitude change of the stirring body.

As shown in FIG. 4B, FIG. 4C, with rotating in 90-degree to 135-degree from this attitude, the upper side of left disk 100L is swung largely to front and the left side of the stirring body is also swung from back to front. At the attitude of the rotation angle 135-degree, the stirring body is twisted in front-back direction in the same attitude as 45-degree so that FIG. 5B shows the trihedral figure of the stirring apparatus 10 whose rotation angle is 135-degree for clarity of the attitude.

Figure 6:
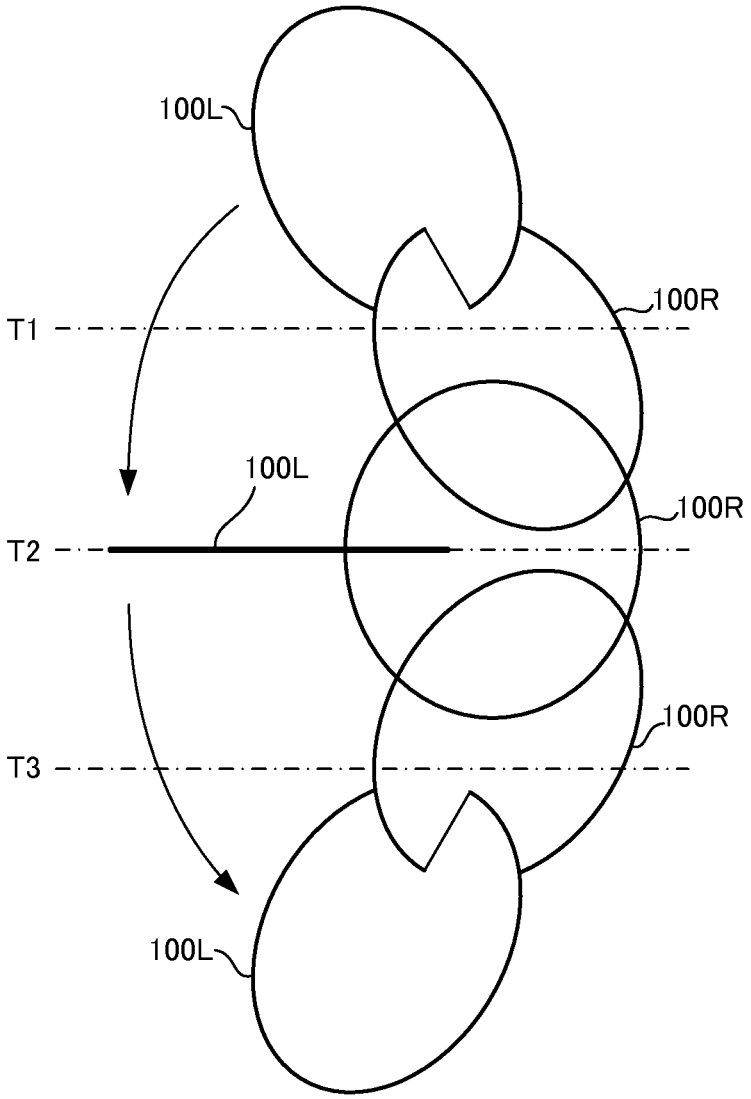
FIG. 6 is a diagram illustrating extrusion and return strokes of the stirring body.
Figure 7A:
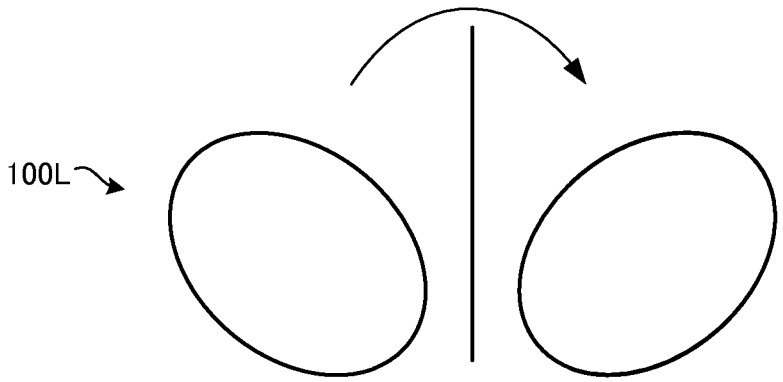
FIG. 7A is a diagram illustrating extrusion and return strokes of the stirring body.

FIG. 6 and FIG. 7A show an attitude change of the left disk 100L during the motion of the stirring body 10 shown in FIGS. 4A, 4B and 4C. FIG. 6 is a top view of the attitude change of the left disk 100L (the stirring body 10), and FIG. 7A is a left side view of the attitude change of the left disk 100L. As shown in FIG. 6 and FIG. 7, the left disk 100L changes its attitude vertical from obliquely upward by its upper part swinging toward the front largely, and then swings till the obliquely downward attitude. At the same time of that, the rotation shaft 100L of the stirring body 10 swings from the attitude that the right side is in front and the left side is in back to the attitude that the right side is in back and the left side is in front. By these series of the motion of "thrusting stroke", the disk 100L thrusts water with its front face. In other words, the thrusting stroke is a motion like making wind with an "uchiwa" fan. In the thrusting stroke, the load to the left disk 100L is large as to thrust water a lot.

As mentioned above, in FIG. 4C and FIG. 5B, when the rotation angle is 135-degree, the stirring body 10 is in the twisted attitude that the right side is in back and the left side is in front as opposed to when it is rotated in 45-degree by the swing of the fork 14R, 14L in front-back direction. As can be seen in the plan view in FIG. 5B, the left disk 100L is located in front slightly toward its periphery in the back-downward direction.

As rotating in 180-degree (0 degrees) to 45-degree, the left disk 100L swings toward the back with the back side of periphery as the head and returns to the attitude in 45-degree shown in FIG. 4A. In this case, the two sides of left disk 100L which is returned to the attitude of FIG. 4A mentioned above are reversed.

Figure 7B:
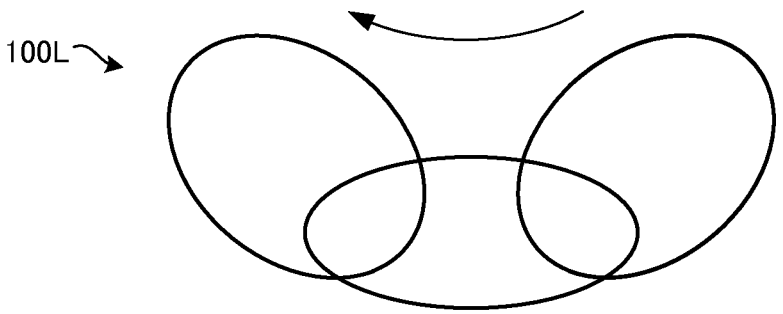
FIG. 7B is a diagram illustrating thrusting and return strokes of the stirring body.
Figure 8A:
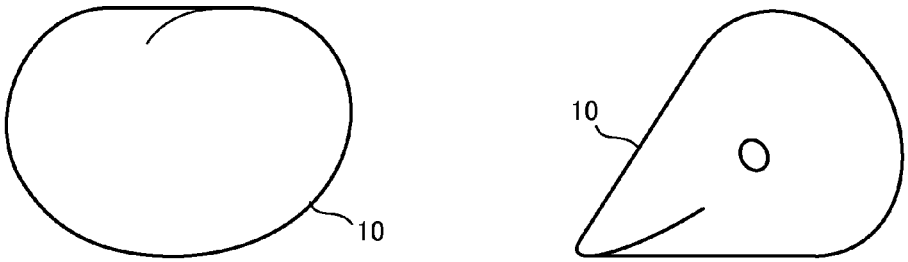
FIG. 8A is a diagram illustrating an attitude change of the stirring body.
Figure 8B:
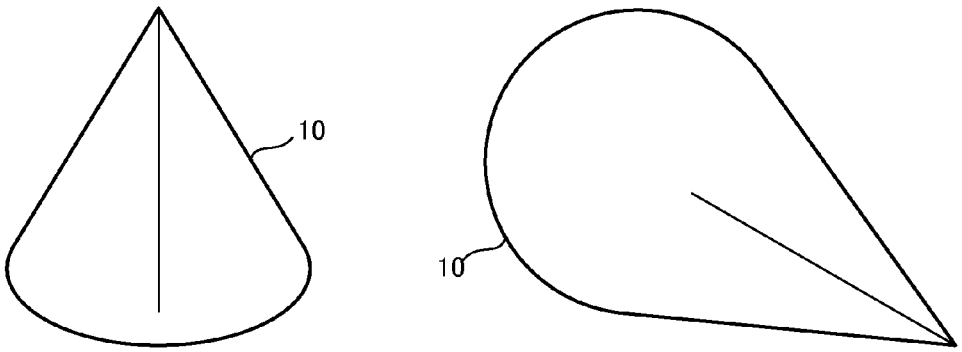
FIG. 8B is a diagram illustrating an attitude change of the stirring body.
Figure 8C:
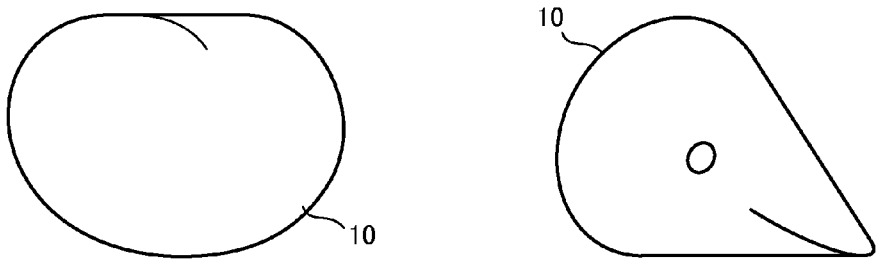
FIG. 8C is a diagram illustrating an attitude change of the stirring body.
Figure 8D:
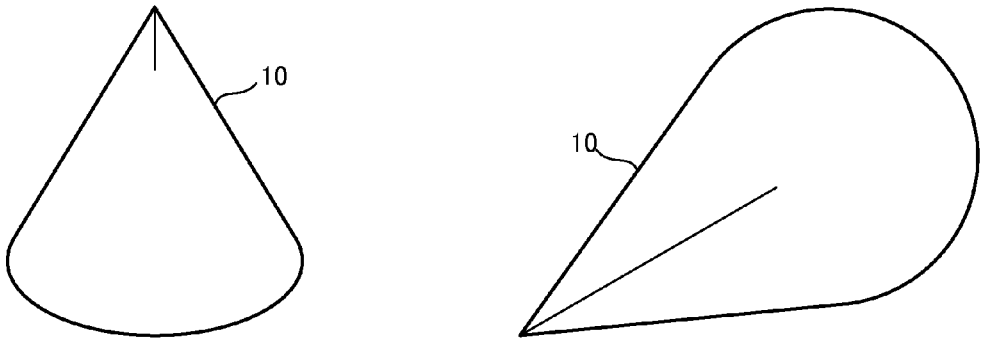
FIG. 8D is a diagram illustrating an attitude change of the stirring body.

FIG. 7B shows the attitude change seen from the left side of the left disk 100L in the motion of the stirring body 10 shown in FIG. 4C to FIG. 4A. As illustrated, the left disk 100L changes its attitude to horizontal (FIG. 4D) and returns to the attitude toward the obliquely upward direction shown in FIG. 4A with swinging towards the in-plane direction as it slides. In these series of the motion of "return stroke", water isn't paddled and few loads are applied because there are few swings toward the planar direction. For example, it is a motion like moving an implement for the goldfish scooping in water. In addition, the attitude change of the right disk 100R in FIG. 6 is reversed right and left, however, it is same as the motion of the left disk 100L at that time.

One stirring cycle is finished when the motion shown in order of FIG. 4A, FIG. 4B, FIG. 4C, FIG. 4D and FIG. 4A are performed and another cycle (the thrusting stroke) is started from the attitude of FIG. 4A.

On the other hand, the disk 100R which is located at the right side of the stirring body 10 is acted reversely (90-degree shifted) to the left disk 100L in the symmetrical position to the left disk 100L. That is, in the period of FIG. 4A, FIG. 4B and FIG. 4C, the return stroke is performed as well as the period of FIG. 4C FIG. 4D and FIG. 4A of the left disk 100L. In the period of FIG. 4C, FIG. 4D and FIG. 4A, the thrusting stroke is performed as well as the period of FIG. 4A, FIG. 4 and FIG. 4C of the left disk 100L. Therefore, a large load is applied to the right disk 100R during the period of FIG. 4C, FIG. 4D and FIG. 4A and is not applied during the period of FIG. 4A, FIG. 4B and FIG. 4C.

Then, referred to FIG. 9, the drive mechanism 30 will be explained. The drive mechanism 30 has a motor 31, a first gear 32 fixed to the rotation shaft of the motor 31, a right second gear 33R meshed with the first gear and a left second gear 33L meshed with the right second gear. The drive mechanism 30 further has third gears 35R and 34L which drive the drive shafts 35R and 35L to rotate respectively meshing with the second gear 33R and 33L respectively. In addition, a right third gear 34R and a left third gear 34L are missing teeth gears as shown in the figure. The angle of missing teeth of the right third gear 34R and the left third gear 34L will be described later.

Figure 9:
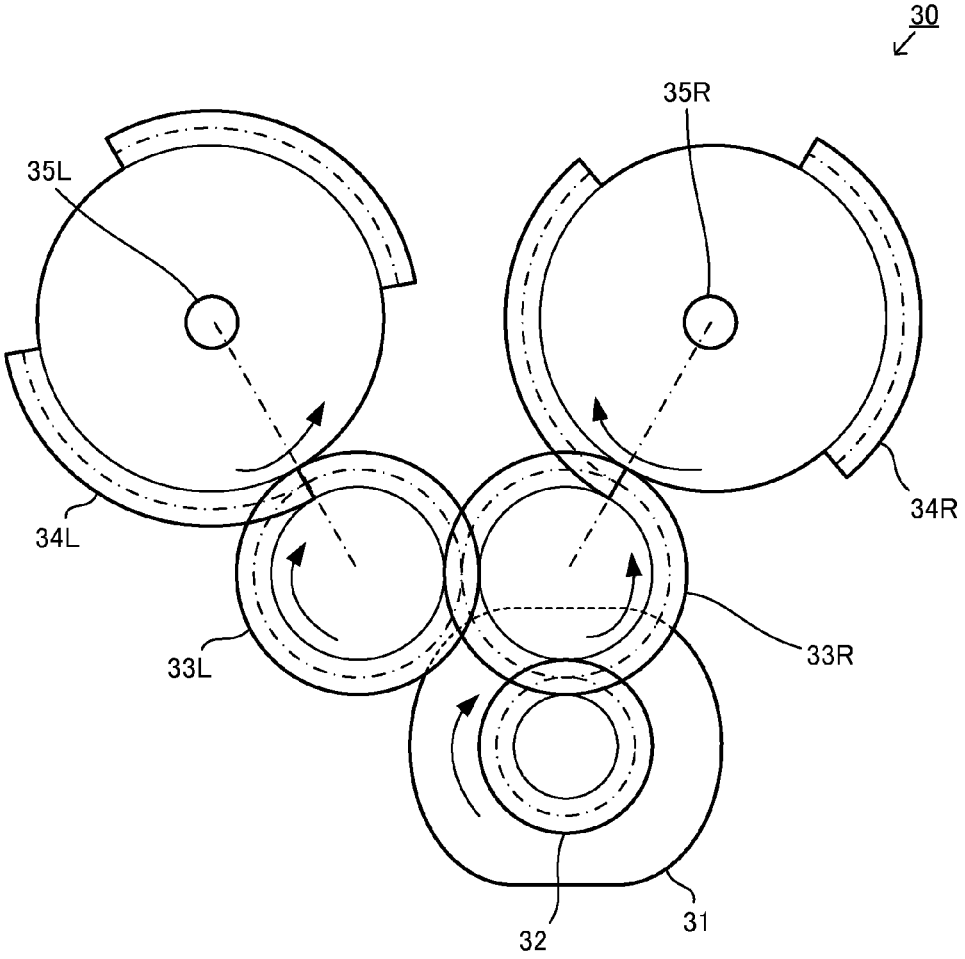
FIG. 9 is a block diagram of a drive mechanism.

In FIG. 9, when the first gear 32 (the motor 31) rotates clockwise (seen from above) as shown by allows in the figure, the right second gear 33R rotates counterclockwise and the left second gear 33L rotates clockwise. Thus, the left third gear 34L and the right third gear 34R, that is, the drive shaft 35L and 35R rotates clockwise and counterclockwise respectively.

Figure 10:
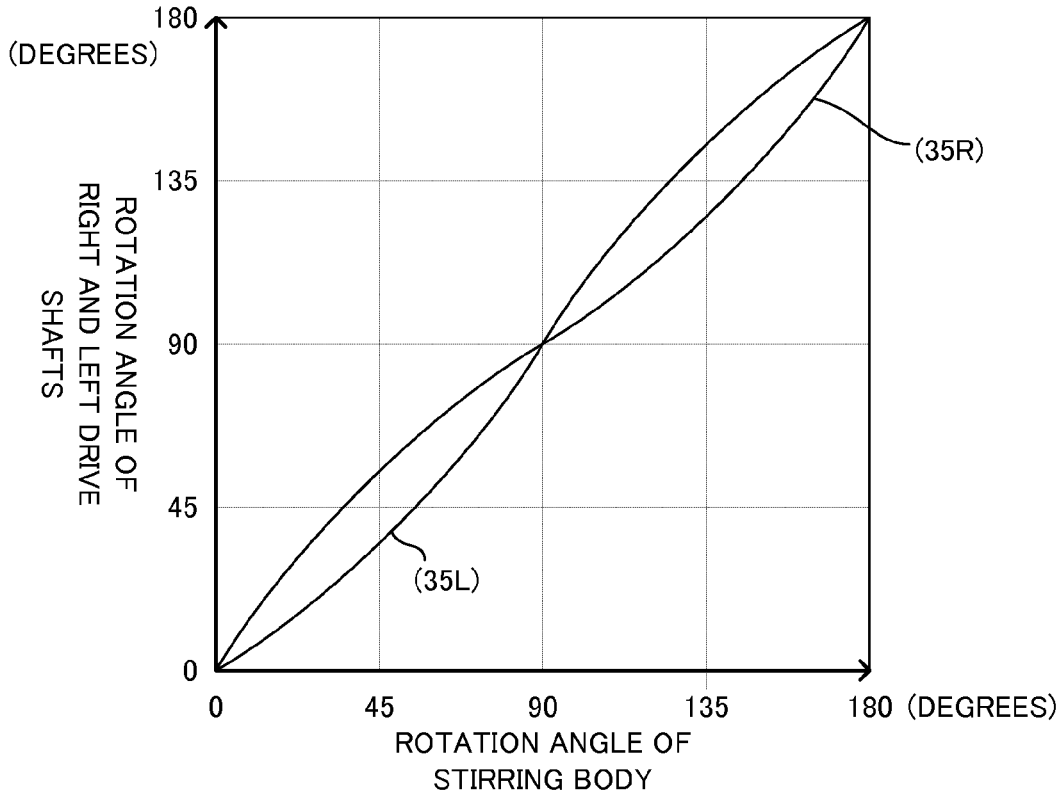
FIG. 10 is a diagram showing the relation between the rotation angle of the stirring body and the rotation angle of the drive shaft.

Here, when the drive shaft and the driven shaft don't lie on a straight line, rotary transmission by the universal joint generally raises synchronization mismatch and periodic angle slip occurs between the drive shaft and the driven shaft. The universal joint 12R, 12L in the embodiment are as well. As shown in FIG. 10, the rotation angle of the rotation shaft 101 of the stirring body 10 and that of the drive shaft 35R, 35L aren't coincident and they change in every 180-degree. Further, as shown in FIG. 1, the fluctuation period of the rotation angle of the rotation shaft 101 and that of the drive shaft 35R, 35L are shifted 90-degree as shown in FIG. 10 because the angles that the support shaft 15R of the right universal joint 12R and the support shaft 15L of the left universal joint 12L intersects with the rotation shaft 101 of the stirring body 10 are at 90-degree. Therefore, if the rotation shaft 35R, 35L are rotated simultaneously at the same velocity (angle velocity), the stirring body 10 doesn't rotate properly because the angle velocities driving the sides of the disk 100R, 100L of the stirring body 10 respectively are different and unreasonable force is added to the drive mechanism 30, the universal joint 12R, 12L, and the stirring body 10.

Therefore, in the drive mechanism 30 shown in FIG. 9, the synchronization mismatch of the rotation angle of the rotation shaft 101 from the rotation angle of the right drive shaft 35R and the left drive shaft 35L is solved by driving the loaded disk and not driving the unloaded disk. That is, one disk which acts the "thrusting stroke" shown in FIG. 7A is driven and the other disk which acts the "return stroke" shown in FIG. 7B is not driven but following the stirring body 10. Thus, inappropriate force isn't added to the drive mechanism 30, the universal shaft 12R, 12L and the stirring body 10, and, it is possible to stir the liquid with sufficient force.

Figure 11A:
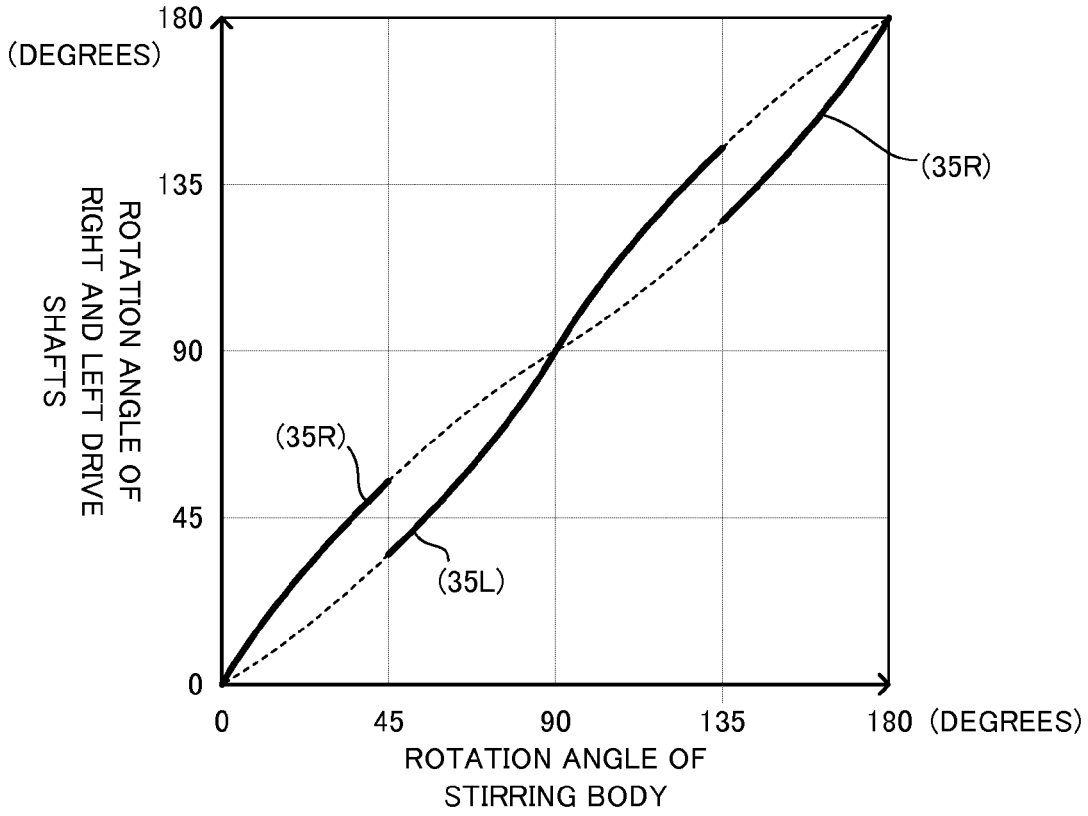
FIG. 11A is a diagram illustrating the range of the rotation angle of the right and left drive shafts.
Figure 11B:
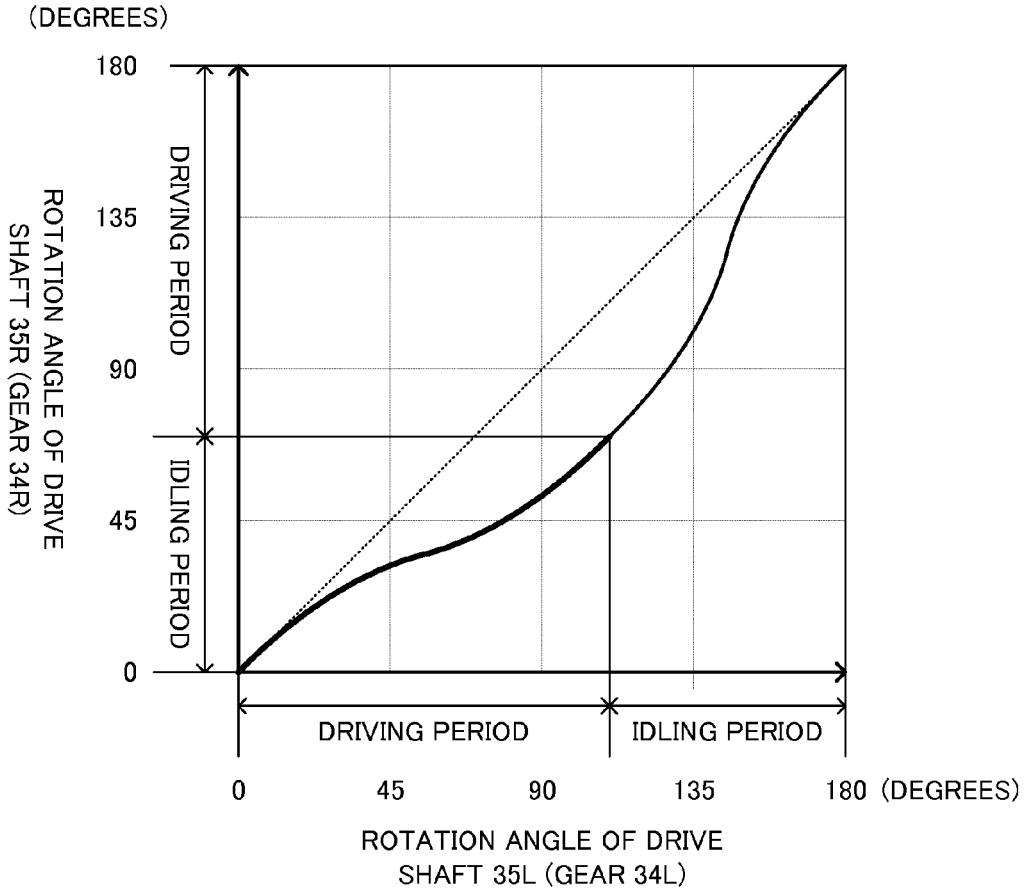
FIG. 11B is a diagram illustrating the range of the rotation angle of the right and left drive shafts.

In the embodiment, as can be seen in the driving period indicated by a thick solid line in FIG. 11A, the drive shaft 35L drives the stirring body 10 made to rotate by the driving force of the motor 31 during the period that the rotation angle of the stirring body 10 (the rotation shaft 101) is from 45-degree to 135-degree. And the drive shaft 35R also drives the stirring body 10 made to rotate by the driving force of the motor 31 during the period that the rotation angle of the stirring body 10 (the rotation shaft 101) is from 0-degree to 45-degree and from 135-degree to 180-degree. Moreover, FIG. 11B shows the relationship between rotation angles between the right rotation shaft 35R and the left rotation shaft 35L mutually, that is, the relationship of changes of the rotation angle of the right rotation shaft 35R to changes of the rotation angle 35L. As shown in this diagram, in the driving period of the rotation shaft, the driving force is transmitted efficiently to the stirring body 10, rotating with the high angle velocity to the other rotation shaft which is in the idling period.

In the case of one revolution (360 degrees) of the stirring body 10, the driving force of the motor 31 is transmitted to the drive shaft 35L to rotate in the period of 45-degree to 135-degree and 225-degree to 315-degree, and the driving force of the motor 31 is transmitted to the drive shaft 35R to rotate in the period of 135-degree to 225-degree and 315-degree to 45-degree. Therefore, conversely, the driving force of the motor 31 is not transmitted to the drive shaft 35L when the rotation angle of the stirring body 10 is in the period of 135-degree to 225-degree and 315-degree to 45-degree, and the driving force of the motor 31 is not transmitted to the drive shaft 35R when the rotation angle of the stirring body 10 is in the period of 45-degree to 135-degree and 225-degree to 315-degree.

As described above, by setting the third gear 34R, 34L that are coaxial with the drive shaft 35R, 35L as a missing teeth gear, the transmission of the driving force of the motor 31 is switched to the drive shaft 35R and the drive shaft 35L.

As shown in FIG. 11A, it is necessary to make the drive shaft 35L rotate in approximately 110 degrees in order that the stirring body 10 is made to rotate in 45-degree to 135-degree. Where the angle of the drive shaft 35L (the third gear 34L) when the rotation angle of the stirring body 10 is 0-degree is defined as 0-degree, it is necessary to make the drive shaft 35L rotate from approximately 35-degree to approximately 145-degree. Therefore, the third gear 34L provides the teeth in the range of approximately 35-degree to approximately 145-degree and makes the range of 0-degree to approximately 35-degree and approximately 145-degree to approximately 180-degree the missing teeth. In the range of one revolution, 360 degrees, teeth may be provided in the range of approximately 35-degree to approximately 145-degree and approximately 215-degree to approximately 325-degree, and it may be the missing teeth in the range of approximately 145-degree to approximately 215-degree and approximately 325-degree to approximately 35-degree.

Further, one cycle of the motion of the stirring body 10 is 180 degrees as mentioned above, and it is necessary to make the drive shaft 35R rotate in approximately 110 degrees in order that the stirring body 10 is made to rotate from 135-degree to 45-degree. Where the angle of the drive shaft 35R (the third gear 34R) when the rotation angle of the stirring body 10 is 0-degree is defined as 0-degree, it is necessary to make the drive shaft 35R rotate from approximately 125-degree to approximately 55-degree. Therefore, the third gear 34R provides the teeth in the range of approximately 125-degree to approximately 55-degree and makes the range of approximately 55-degree to approximately 125-degree the missing teeth. In the range of one rotation, 360 degrees, teeth may be provided in the range of approximately 125-degree to approximately 235-degree and approximately 305-degree to approximately 55-degree, and it may be the missing teeth in the range of approximately 235-degree to approximately 305-degree. The third gear 34R, 34L shown in FIG. 9 are the missing teeth gears missing teeth in the range of the angle mentioned above.

FIG. 12 is a diagram illustrating the meshing angle between the right third gear 34R, the left third gear 34L and the right second gear 33R, the left second gear 33L, which are the missing teeth gears. In order to facilitate understanding, in this figure, it is described that the left second gear 33L, the left third gear 34L and the right second gear 33R, the right third gear 34R are located in parallel though it is different from the block diagram in FIG. 9. Each of the figures from FIG. 12A to FIG. 12D corresponds to each of the figures from FIG. 4A to FIG. 4D.

Figure 12A:
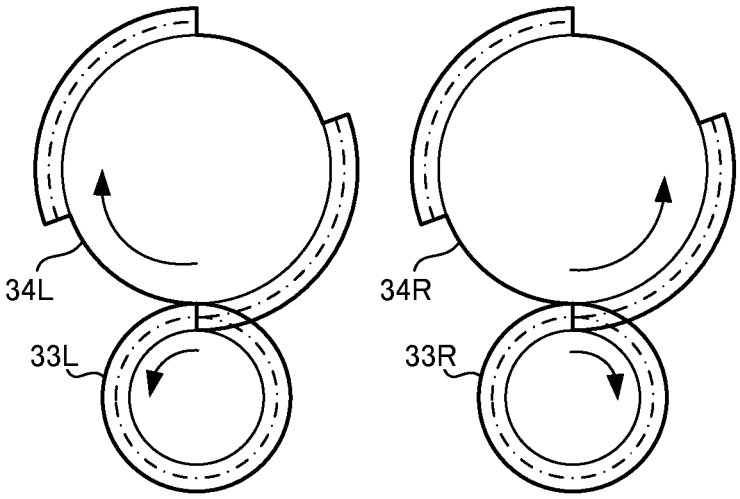
FIG. 12A is a diagram illustrating the phase relationship of the two missing teeth gears.
Figure 12B:
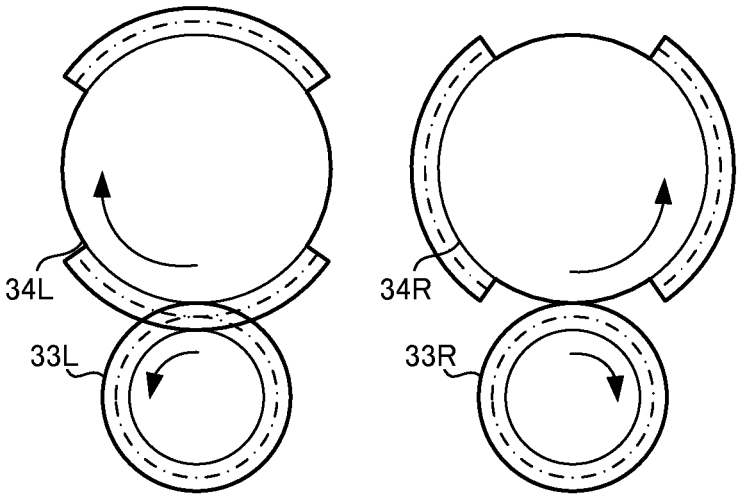
FIG. 12B is a diagram illustrating the phase relationship of the two missing teeth gears.

In FIG. 12A, when the rotation angle of the stirring body 10 is 45-degree, the teeth angular range of the left third gear 34L starts to oppose the left second gear 33L and to mesh with it, and the missing teeth angular range of the right third gear 34R starts to oppose the right second gear 33R and to disengage with it. In FIG. 12B, when the rotation angle of the stirring body 10 is 90-degree, the teeth angular range of the left third gear 34L opposes the left second gear 33L and meshes with it and the missing teeth angular range of the right third gear 34R opposes the right second gear 33R and disengages with it. In this case, the right drive shaft 35R and the right third gear 34R are following the rotation of the universal joint 12R caused by rotational swing of the stirring body 10.

Figure 12C:
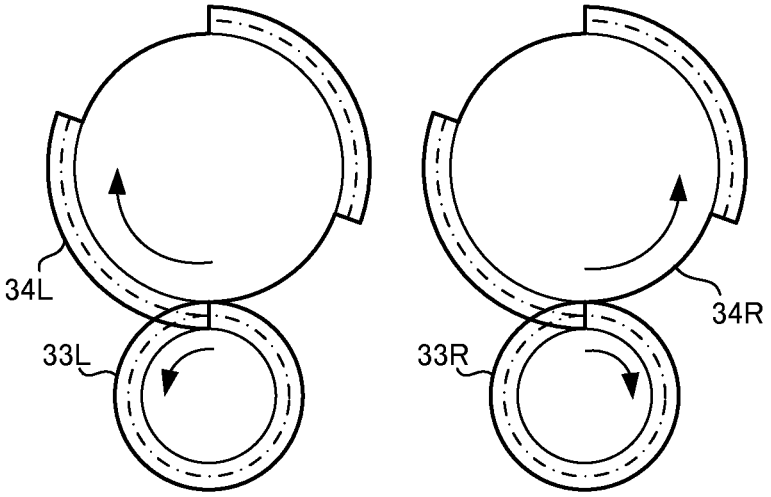
FIG. 12C is a diagram illustrating the phase relationship of the two missing teeth gears.
Figure 12D:
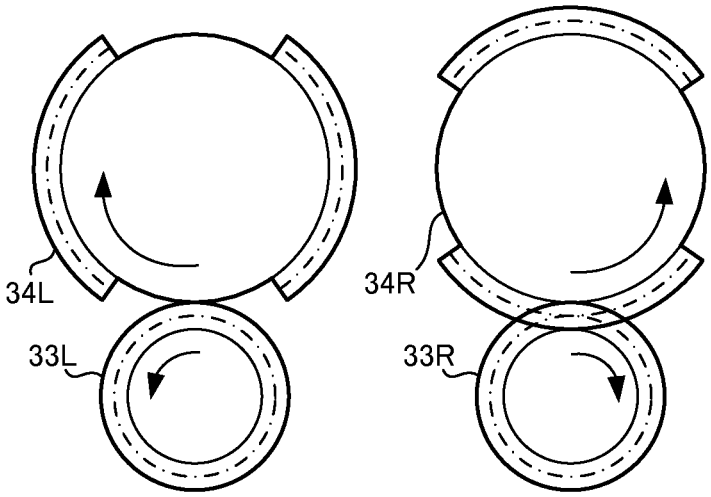
FIG. 12D is a diagram illustrating the phase relationship of the two missing teeth gears.

In FIG. 12C, when the rotation angle of the stirring body 10 is 135-degree, the missing teeth angular range of the left third gear 34L starts to disengage with the left second gear 33L opposing and the teeth angular range of the right third gear 34R starts to oppose the right second gear 33R and to mesh with it. In FIG. 12D, when the rotation angle of the stirring body 10 is 180-degree (0-degree), the missing teeth angular range of the left third gear 34L opposes the left second gear 33L and disengages with it, and the teeth angular range of the right third gear 34R opposes the right second gear 33R and meshes with it. In this case, the left drive shaft 35L and the left third gear 34L are following the rotation of the universal joint 12L caused by rotational swing of the stirring body 10.

Graphs shown in FIG. 10 and FIG. 11 are examples of the stirring apparatus having a shape shown in FIG. 1 and can be obtained by calculation or experiments on the basis of the shape of the stirring body 10, the universal joint 12R, 12L, an interval between the drive shaft 35R, 35L, and the like. Therefore, the invention is not limited to the numerical value of the graphs in FIG. 10, FIG. 11A and FIG. 11B.

The angular range of the missing teeth of the right third gear 34R and the left third gear 34L may be determined in the adjustable angle of the number of the teeth. The switching structure between transmitting and releasing the driving force of the motor 30 may not also be limited to the missing teeth gear. For example, transmitting and releasing the driving force may be controlled by the arm which supports the gear which relays the driving force. The arm is moved in response to the rotation angle. Moreover, it may be constituted as follows so that the front end of the teeth angular range of the right third gear 34R can mesh smoothly with the right second gear 33L and the front end of the teeth angular range of the left third gear 34L can mesh smoothly with the left second gear 33L.

Figure 13:
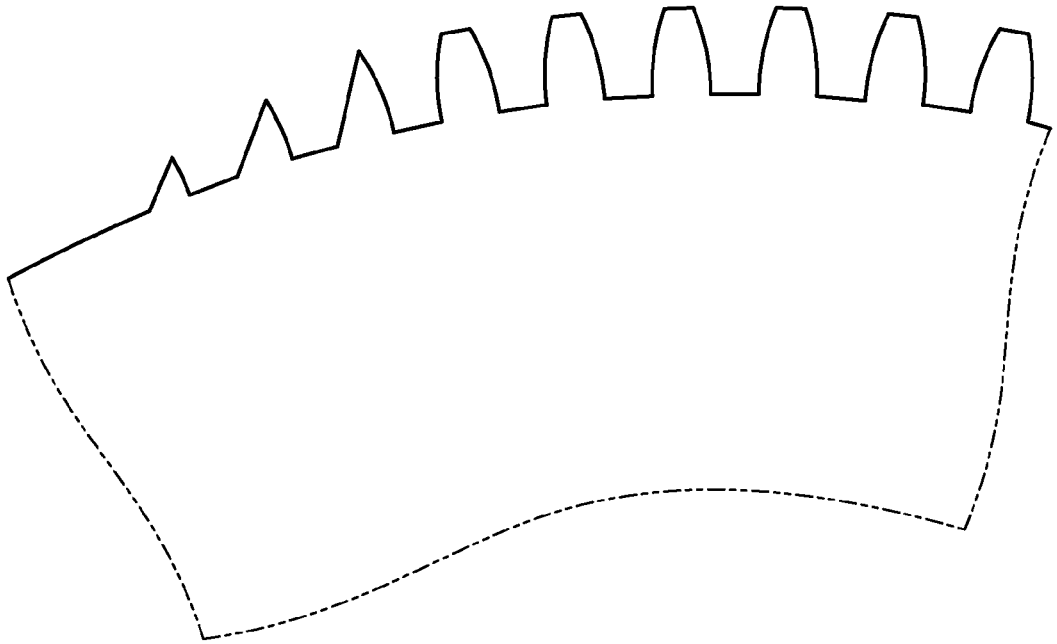
FIG. 13 is a diagram showing a structure example for the teeth of the missing teeth gear.

For example, driving of the right and left may be overlapped by driving the right rotation shaft 35R and the left driving shaft 35L a little longer than the driving period shown in FIG. 11A. Further, backlash may be provided to the mesh by cutting off a part of the tooth of the meshing start area and the meshing end area as shown in FIG. 13. In this case, the side of the tooth which contacts to the second gear at the end of meshing should be cut off.

Figure 14:
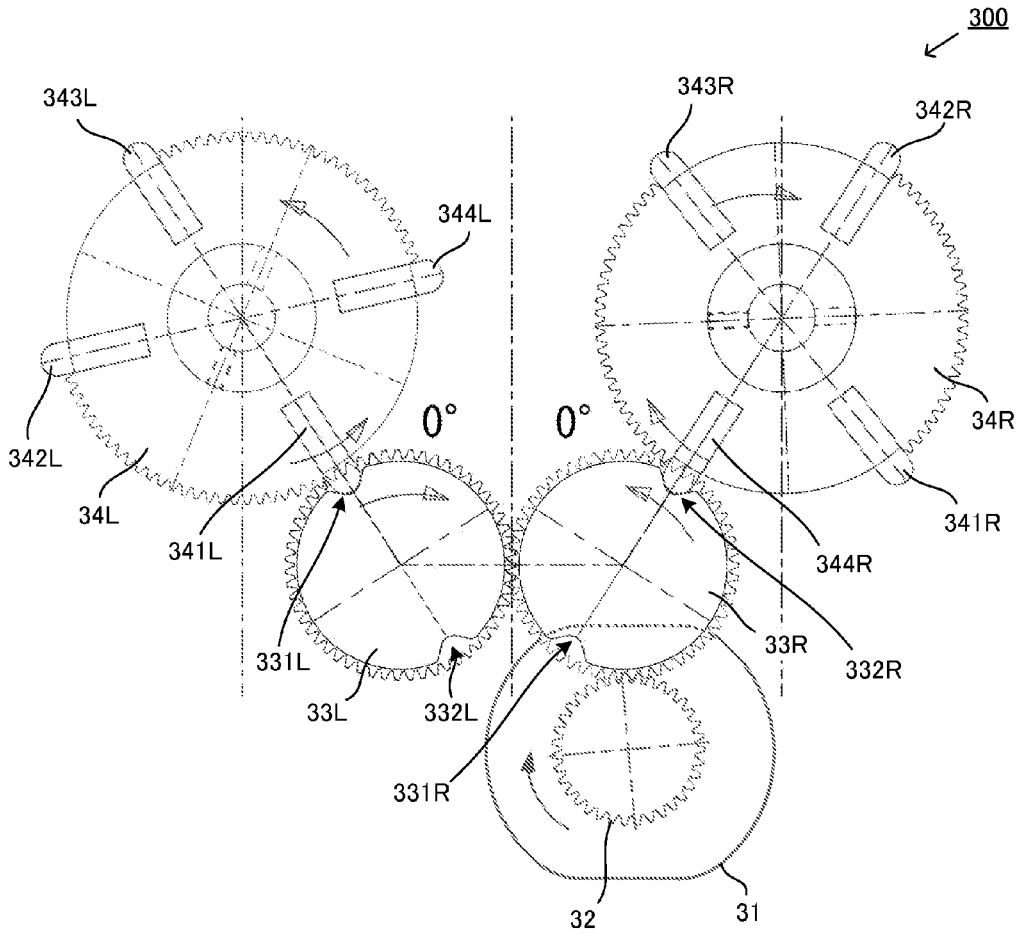
FIG. 14 is a diagram showing a structure example that the rotation guides are provided to the missing teeth gear of the drive mechanism and the power-driven gear.

In addition, a rotation guide which guides to mesh exactly may further be provided to the drive mechanism 30 shown in FIG. 9. An example of a drive mechanism 300 wherein the rotation guide is provided is shown in FIG. 14. In the drive mechanism 300, the guide pins 341L to 344L sticking out from the outer periphery of the gear are provided at the four points on the boundary parts between the teeth angular range and the missing teeth angular range of the left third gear 34L. Further, the guide pins 341R to 344R sticking out from the outer periphery of the gear are provided at the four points on the boundary parts between the teeth angular range and the missing teeth angular range of the right third gear 34R. The guide pins 341L to 344L and 341R to 344R are bigger than the tip of the tooth of the gear. The concave unit 331R, 332R and 331L, 331R are respectively provided on the side of the right second gear 33R and the left second gear 33L as the rotation guide, which are provided at the two points each of the second gear 33L and 33R in the symmetrical position to the rotation shaft. In the drive mechanism 300, number of teeth of the teeth angular range of the right third gear 34R and the left third gear 34L is set to be same as number of teeth of the right second gear 33R and the left second gear 33L. That is, number of teeth of one teeth angular range of the right third gear 34R or the left third gear 34L is same as the half of the number of teeth of the right second gear 33R or the left second gear 33L.

Each tip of the guide pins 341R-344R and 341L-344L is shaped of a semi-circular (arc). Each of the concave unit 331R, 332R, 331L and 332L are constituted so that their aperture angles, for example, can become 90-degree with their bottom parts being semi-circular (arc) whose diameters are longer than those of the guide pins 341R-344R and 341L-344L.

As shown in FIG. 14, the teeth angular range of the left second gear 33R and the teeth angular range of the left second gear 33L are made to mesh with the right third gear 34R and the left third gear 34L respectively as the guide pin 331L engages with the convex unit 341L and the guide pin 331R engages with the convex unit 341R opposing.

Almost no backlash of the concave units 331L, 332L to the guide pins 341L-344L is at the center of the concave unit 331L, 332L and the backlash increases as the guide pins 341L-344L are departing from the center of the concave unit 331L, 332L. Similarly, almost no backlash of the concave unit 331R, 332R to the guide pins 341R-344R is at the center of the concave unit 331R, 332R and the backlash increases as the guide pins 341R-344R are departing from the center of the concave unit 331R, 332R. Thus, even if the rotation angles of the right third gear 34R and the left third gear 34L are drifted slightly, the meshing position can be adjusted at the front end part of the teeth angular range, and the front end parts of the right third gear 34R and the left third gear 34L mesh smoothly with the right second gear 33R and the left second gear 33L respectively.

FIG. 4 shows the position wherein the guide pin 344R and the concave part 332R, and the guide pin 341L and the concave part 331L are opposed exactly in front respectively, that is, the position of 0-degree. That means it shows the position of the moment that the position of the left third gear 34L being opposed to the left second gear 33L switches to the teeth angular range from the missing teeth angular range.

Figure 15A:
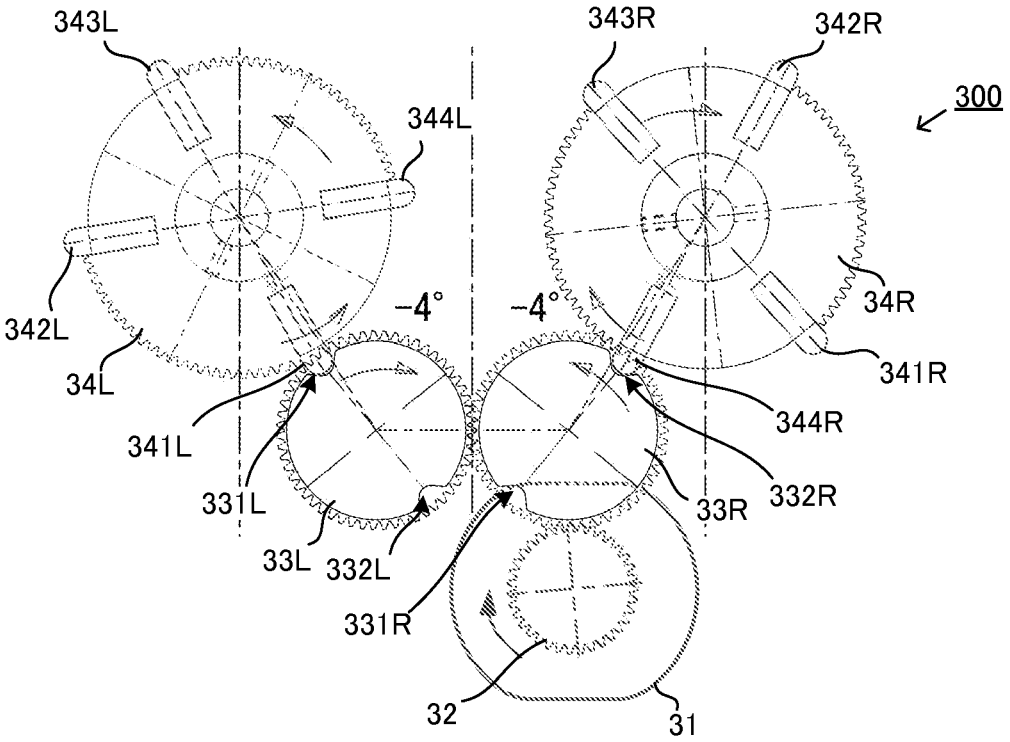
FIG. 15A is a diagram showing an example for the different rotation position of the missing teeth gear of the drive mechanism and the power-driven gear.
Figure 15B:
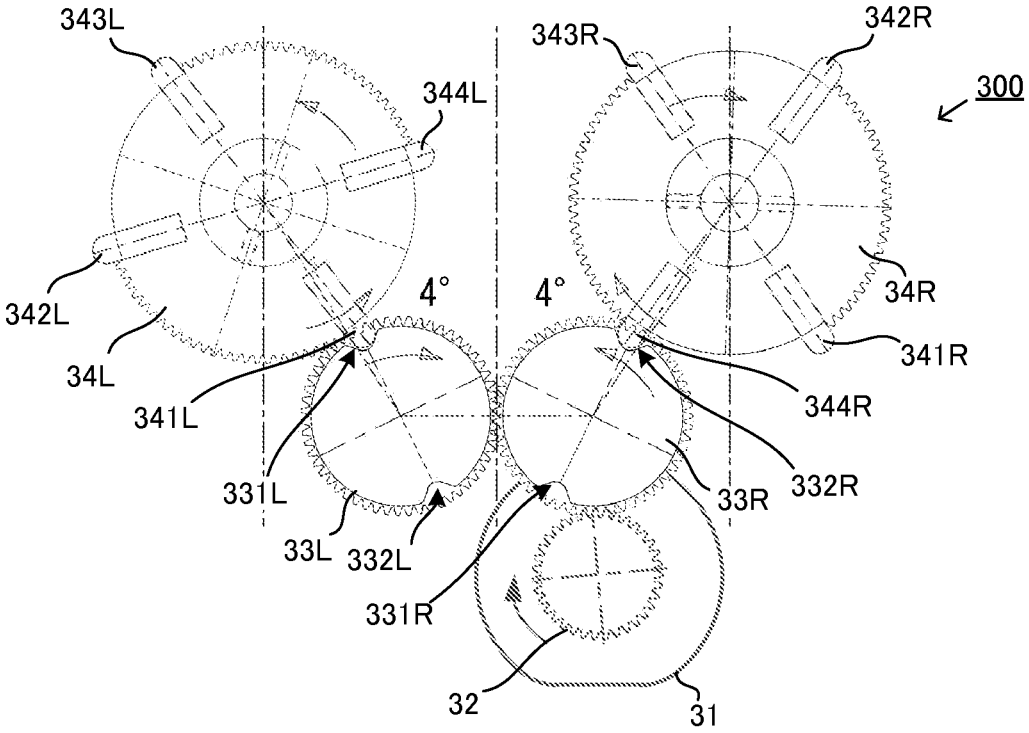
FIG. 15B is a diagram showing an example for the different rotation position of the missing teeth gear of the drive mechanism and the power-driven gear.

FIG. 15A is a diagram showing a position before 4-degree of FIG. 14. When the rotation angle is 4-degree before from the exact front as shown in the figure, it is possible for the teeth angular range 341L to start engaging smoothly because backlash is large, which is aperture width of the concave part 331L. FIG. 15B is also a diagram showing a position after 4-degree of FIG. 14. When the rotation angle is 4-degree after to the exact front as shown in the figure, it is possible for the teeth angular range 341L to release the engagement smoothly because backlash becomes large, which is aperture width of the concave part 331L.

In FIG. 14, the position of the guide pin 341L and the concave part 331L as rotation guides is adjusted so as to make them engage without backlash and the front end of the teeth angular range of left third gear 34L and the left second gar 33L mesh without shift. Consequently, the stirring body 10 is driven to rotate by the left second gear 33L and the left third hear 34.

After that, when the right second gear 33R and the left second gear 33L rotates 180-degree, the back end of the left third gear 34L is gone away from the left second gear 33L. In this case, the convex unit 341R and the concave unit 331R which are the rotation guides of the right side are meshed without play and the location is adjusted so that the front end of the gear unit of the right third gear 34R and the right second gear 33R can be meshed without shift. Consequently, the stirring body 10 keeps to be driven to rotate by the right second gear 33R and the right third gear 34R.

Thus, in the structure, when the teeth angular range of the third gear 34R, 34L starts to mesh with the second gear 33R, 33L, the meshing position is guided exactly by the rotation guide so that the shift of meshing of the gears does not occur and smooth rotation can be achieved.

In addition, in the case of the rotation direction as shown by allows in FIG. 14, FIG. 15A and FIG. 15B, the concave parts 332R and 332L and the guide pins 342R, 344R, 342L and 244L may not be needed. However, in the case of rotating in the inverse direction to the allows, the concave part 332R, 332L and the guide pin 342R, 344R, 342L and 244L functions as describes above instead of the concave part 331R, 331L and the convex part 341R, 343R, 341L and 243L.

A form of the rotation guide is not limited to FIG. 14 and FIG. 15 as long as the meshing position is precisely guided when the gear unit of the third gear 34R, 34L and the second gear 33R, 33L starts to mesh together.

A gear is not limited to a general spur gear, for example, it may be a helical gear or a double helical gear. The first tooth may be deformed to mesh smoothly with the end part of the missing teeth angular range (the starting part of the teeth angular range). A circumferential rib may be stood on the tooth bottom circle and a groove which meshes with the rib may be provided at the edge. Further, the power transmitting parts of the drive mechanism 30 is not limited to the gear, for example, it may be applied a roller and the like.

In this embodiment, the stirring body 10 is the envelope shape of the two circle roller, however, the two circle roller as it is may be used as the stirring body 10. Further, the center distance of the two circle roller is not limited to $\sqrt{2}r$, for example, it may be applied an envelope shape of center distance "r" enclosed by a line connecting the grounding points. Thus, any shapes may be applied as long as the right and left stirring face has an angle of 90-degree.

REFERENCE SIGNS LIST

1 stirring apparatus
10 stirring body
12R, 12L universal joint
30 drive mechanism
33R, 33L second gear
331R, 332R, 331L, 332L concave part
34R, 34L third gear (missing teeth gear)
341R-344R, 341L-344L guide pin
35R, 35L drive shaft
100R, 100L disk (of two circle roller)
101 rotation shaft

What is claimed is:

1. A stirring apparatus comprising;

a stirring body which has a rotation shaft and first and second stirring fins provided along the shaft direction of the rotation shaft;

first and second drive shafts which the rotation shaft and the shaft center aren't in-line;

a first shaft coupling for connecting the first drive shaft to the side of the first stirring fin of the rotation shaft;

a second shaft coupling for connecting the second drive shaft to the side of the second stirring fin of the rotation shaft;

a driving unit for driving the first and second drive shaft to rotate, wherein the driving unit comprises a first missing teeth gear for intermittently transmitting driving force to the first drive shaft, a second missing teeth gear for intermittently transmitting driving force to the second drive shaft and a power-driven gear for transmitting driving force to the first and second missing teeth gear; and wherein the driving unit further comprises a regulating member for making the first gear oppose the power-driven gear with little backlash at the rotational position where the boundary between a teeth angular range of the first gear and a missing teeth angular range is opposed to the power-driven gear and making the second gear oppose the power-driven gear with little backlash at a rotational position where the boundary between a teeth angular range of the first gear and a missing teeth angular range is oppose to the power-driven gear.

2. The stirring apparatus according to claim 1, wherein the regulating member makes backlash of the first gear and the power-driven gear increase as the rotational position of the first gear departs from the position where the boundary between the teeth angular range and a missing teeth angular range is opposed to the power-driven gear; and wherein the regulating member makes backlash of the second gear and the power-driven gear increase as the rotational position of the second gear departs from the position where the boundary between the teeth angular range and the missing teeth angular range is opposed to the power-driven gear.

3. The stirring apparatus according to claim 1, wherein the first stirring fin has a first stirring face;

the second stirring fin has a second stirring face whose direction is different from the first stirring face;

the driving unit drives the first drive shaft to rotate with the first missing teeth gear meshing with the power-driven gear and the second missing teeth gear being opposed to the power-driven gear when the first stirring fin swings to the direction of the first stirring face;

the driving unit drives the second drive shaft to rotate with the second missing teeth gear meshing with the power-driven gear and the second missing teeth gear opposed to the power-driven gear when the second stirring fin swings to the direction of the second stirring face; and driving only either of the first or second drive shafts to rotate exclusively is carried out.

4. The stirring device according to claim 1, wherein the stirring body has a center at a prescribed interval on the rotation shaft; and a projection image of the central axis direction is an envelope shape of a two circle roller comprising of two disks which have same diameters orthogonal each other.

5. The stirring device according to claim 4, wherein the prescribed interval is the interval of $\sqrt{2}$ times the radius of the disk.

6. A stirring apparatus comprising;

a stirring body which has a rotation shaft and first and second stirring fins provided along the shaft direction of the rotation shaft, the first stirring fin having a first stirring surface that faces in a first stirring surface direction, and the second stirring fin having a second stirring surface that faces in a different direction from the first stirring surface direction, which is a second stirring surface direction;

first and second drive shafts of which shaft centers aren't in-line to the rotation shaft;

a first shaft coupling for connecting the first drive shaft to the side of the first stirring fin of the rotation shaft;

a second shaft coupling for connecting the second drive shaft to the side of the second stirring fin of the rotation shaft;

a driving unit for driving the first and second drive shaft to rotate, wherein the driving unit drives the first drive shaft, but does not drive the second drive shaft, to rotate while the first stirring fin swings toward the first stirring surface direction, the driving unit drives the second drive shaft, but does not drive the first drive shaft, to rotate while the second stirring fin swings toward the second stirring surface direction, the driving unit further comprises a first missing teeth gear for transmitting driving force to the first drive shaft and a second missing teeth gear for transmitting driving force to the second drive shaft, a missing teeth part of the first missing teeth gear faces a teeth gear at a power side while the second missing teeth gear mates with the teeth gear at the power side, and a missing teeth part of the second missing teeth gear faces a teeth gear at the power side while the first missing teeth gear mates with the teeth gear at the power side.

7. The stirring device according to claim 6, wherein the stirring body has a center at a prescribed interval on the rotation shaft; and a projection image of the central axis direction is an envelope shape of a two circle roller comprising of two disks which have same diameters orthogonal each other.

8. The stirring device according to claim 7, wherein the prescribed interval is the interval of $\sqrt{2}$ times the radius of the disk.

* * * * *